US010098457B2

(12) United States Patent
Gagne

(10) Patent No.: US 10,098,457 B2
(45) Date of Patent: Oct. 16, 2018

(54) CONVERTIBLE FURNITURE ARTICLE

(71) Applicant: Gilles Robert Gagne, Apopka, FL (US)

(72) Inventor: Gilles Robert Gagne, Apopka, FL (US)

( * ) Notice: Subject to any disclaimer, the term of this patent is extended or adjusted under 35 U.S.C. 154(b) by 0 days.

(21) Appl. No.: 15/045,376

(22) Filed: Feb. 17, 2016

(65) Prior Publication Data

US 2016/0242541 A1 Aug. 25, 2016

Related U.S. Application Data

(60) Provisional application No. 62/118,525, filed on Feb. 20, 2015.

(51) Int. Cl.
*A47B 85/06* (2006.01)

(52) U.S. Cl.
CPC ..... *A47B 85/06* (2013.01)

(58) Field of Classification Search
CPC ..... A47B 85/00; A47B 43/00; A47B 45/00; A47F 5/10; A47F 5/12; A47F 5/0087; A47F 5/108; A47F 5/16; A47F 2005/165; A47F 57/045; A47F 57/04
See application file for complete search history.

(56) References Cited

U.S. PATENT DOCUMENTS 2,147,347 A * 2/1939 Jury ..... B65G 11/186 248/456
2,483,263 A * 9/1949 Cummings ..... A47B 43/00 211/130.1
2,883,064 A * 4/1959 McKenzie ..... A47F 5/13 108/99
3,712,521 A * 1/1973 Tanner ..... D05B 91/14 211/150
5,590,796 A * 1/1997 Herman ..... A47F 5/108 108/99
5,730,068 A * 3/1998 Rioux, Jr. ..... A47F 5/10 108/3
6,105,797 A * 8/2000 Haisma ..... A47F 5/137 211/130.1
6,112,918 A * 9/2000 Burgess ..... A47B 57/04 108/101
6,321,663 B1 * 11/2001 Rogers ..... A47B 43/00 108/100
6,571,969 B2 * 6/2003 Larbaletier ..... A47F 5/12 108/106
8,281,943 B2 * 10/2012 Suman ..... A47F 5/0087 211/150

(Continued)

*Primary Examiner* — Patrick D Hawn
(74) *Attorney, Agent, or Firm* — GrayRobinson, P.A.; Michael J. Colitz, III

(57) ABSTRACT

Disclosed is a convertible article of furniture. The article includes a pair of side rails, with braces formed along an intermediate extent of the side rails. A series of pivotal support bars are also positioned along the pair of side rails. Forwardly and rearwardly located legs are included for supporting the side rails above the ground. The legs are pivotally related to the side rails. The article also includes a series of shelves, with each shelf being pivotally mounted between the pair of side rails. As such, the support bars can be used to selectively support the shelves at an angle relative to the side rails. Alternatively, the shelves can be supported by the braces such that the shelves are aligned with the side rails.

2 Claims, 4 Drawing Sheets

(56) References Cited

U.S. PATENT DOCUMENTS

| | | | | |
|---|---|---|---|---|
| 8,464,878 | B2 * | 6/2013 | Andersen | A47F 1/12 211/150 |
| 2011/0068071 | A1 * | 3/2011 | Suman | A47F 5/0087 211/87.01 |
| 2012/0267329 | A1 * | 10/2012 | Herman Baran | A47F 1/06 211/59.2 |

* cited by examiner

CONVERTIBLE FURNITURE ARTICLE

RELATED APPLICATION DATA

This application claims priority to application Ser. No. 62/118,525 filed on Feb. 20, 2015, and entitled "Convert-a-Table." The contents of this application are fully incorporated herein for all purposes.

BACKGROUND OF THE INVENTION

Field of the Invention

The present invention relates to an article of convertible furniture. More particularly, the present invention relates to a piece of furniture that has both flat and tiered configurations.

Description of the Background Art

The table is one of the most ubiquitous articles of furniture in existence. Tables are a common part of everyone's day-to-day activities. Tables are used everywhere. Dining room tables are use for eating, desks are used for working, card tables are used for playing games, conference room tables are used for transacting business, and display tables are used for showcasing objects. Tables come in any manner of styles and configurations. Tables are most commonly static objects, designed to stay in one place for long periods of time.

Nonetheless, some tables are portable. Portable tables may have foldable legs to allow the table to be configured for transport or storage. The configurability of tables, however, tends to be limited. One erected, there are few, in any, ways to adjust the table to increase its functionality or usability.

Therefore, it is an object of this invention to provide an improvement which overcomes the aforementioned inadequacies of the prior art devices and provides an improvement which is a significant contribution to the advancement in the art of convertible furniture.

It is therefore an object of the present disclosure to provide an article of furniture that is convertible between tiered and flat configurations.

It is another object of the present disclosure to provide an article of furniture that is convertible between tiered, flat, and collapsed configurations.

It is still yet another object of the present disclosure to provide an article of furniture with a number of shelves, whereby the shelves can be arranged in a stepped configuration to promote ease of access.

Another object of this invention is to provide an article of furniture with shelves can be quickly rearranged to change their angular configuration.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a convertible article of furniture. The article includes a pair of side rails, with braces formed along an intermediate extent of the side rails. A series of pivotal support bars are also positioned along the pair of side rails. Forwardly and rearwardly located legs are included for supporting the side rails above the ground. The legs are pivotally related to the side rails. The article also includes a series of shelves, with each shelf being pivotally mounted between the pair of side rails. As such, the support bars can be used to selectively support the shelves at an angle relative to the side rails. Alternatively, the shelves can be supported by the braces such that the shelves are aligned with the side rails.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present disclosure relates to a convertible article of furniture. The furniture includes a pair of parallel side rails and forward and rearward support legs. A series of shelves are pivotally mounted between the parallel side rails. The article has a tiered configuration wherein each of the shelves is angled relative to the parallel side rails by way of a series of support bars. The support bars can be released by way of quick release pins such that the shelves are aligned with the parallel side rails. This is the flat configuration. A collapsed configuration can also be attained by placing both the support legs and the shelves in alignment with the parallel side rails. The various components of the present invention, and the manner in which they interrelate, are described in greater detail hereinafter.

Figure 1:
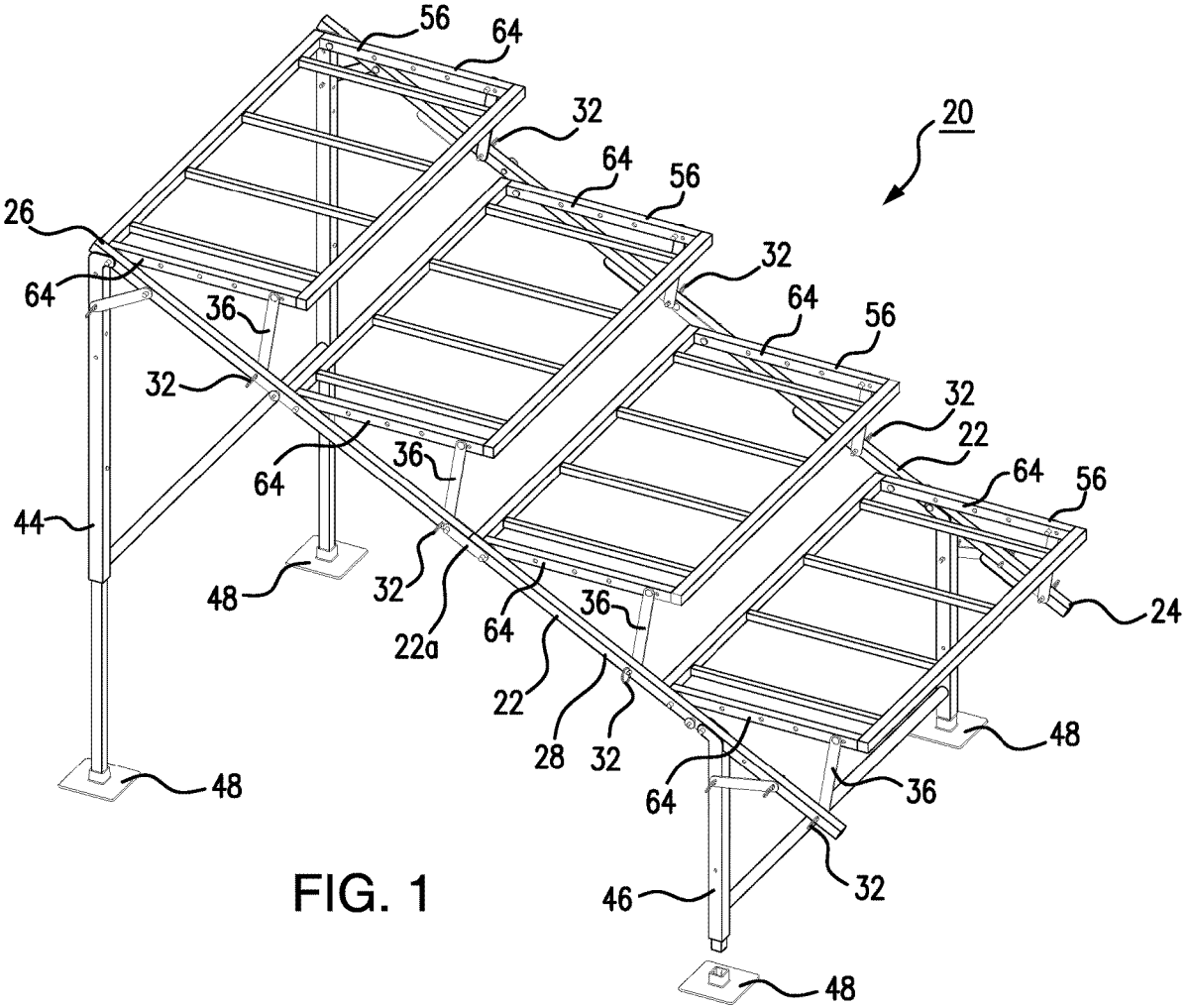
FIG. 1 is a perspective view of the article of furniture in the tiered configuration.

FIG. 1 is a perspective of the article of furniture 20 in the tiered configuration. As illustrated, the article is defined by a pair of parallel side rails 22. An intermediate linkage 22*a* can be used to connect two individual side rails in an end to end fashion. Side rails 22 define the sides of article 20. The side rails 22 include a forward extent 24, a rearward extent 26, and an intermediate extent 28 therebetween. A series of quick release pins 32 and braces 34 are formed along the intermediate extent 28 of the side rails 22. The function of these pins 32 and braces 34 are described in greater detail hereinafter.

With continuing reference to FIG. 1, a series of pivotal support bars 36 are illustrated. In the illustrated embodiment four pairs of support bars 36 are employed. Each individual support bar 36 includes a proximal end 38 that is removably coupled to the intermediate extent of the parallel side rails 22 by way of a corresponding quick release pin 32. Support bars 36 also include a distal end 40 that is attached to a shelf. The quick release pins 32 permit the end of the support bar 36 to be removed from a corresponding aperture in one of the parallel side rails 22.

Figure 2:
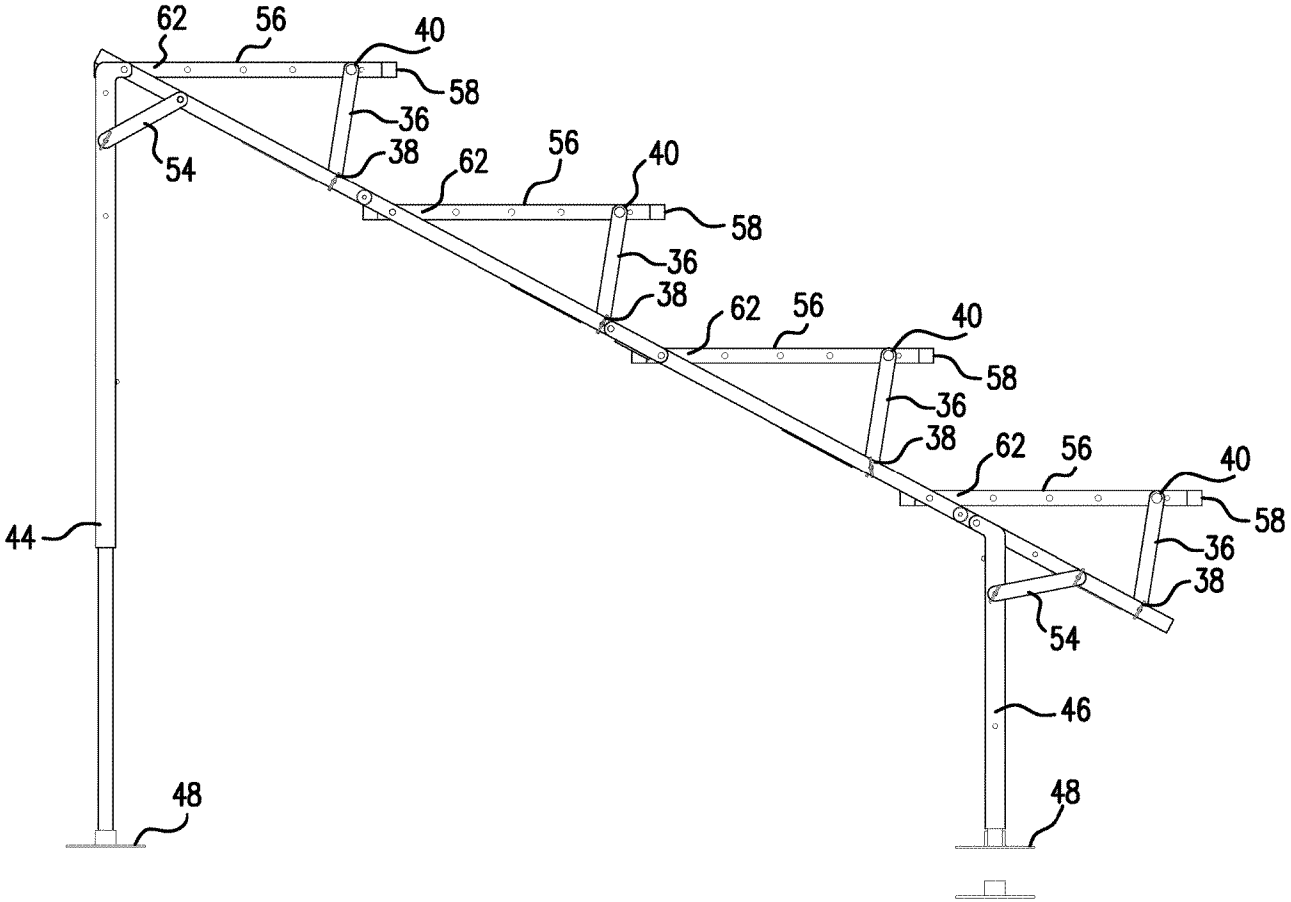
FIG. 2 is a side elevational view of the article of furniture in the tiered configuration.

The furniture 20 is supported above the ground via rearward and forward located legs (44 and 46, respectively). More specifically, a pair of rearward legs 44 is pivotally connected to the rearward extent 26 of the parallel side rails 22, and a pair of forward legs 46 is pivotally connected to the forward extent 46 of the parallel side rails 22. Both the rearward and forward legs (44 and 46, respectively) are telescopically adjustable between extended and retracted positions. As illustrated in FIGS. 1 and 2, a pair of feet 48 are removably mounted to the bottom of each of the legs. Each of the legs optionally includes a cross bar for added support and stability. When in the tiered configuration, the forward legs 46 can be telescopically adjusted to be shorter than the rearward legs 44. This allows items placed on the various shelves to be easily accessible. Angled support links 54 can be included as a means of supporting the rearward and forward legs (44 and 46).

With continuing reference to FIGS. 1 and 2, the shelving is next described. The article is designed to support a series of different shelves 56. Although the depicted shelves 56 are formed from a frame, an insert can be provided such that each of the shelves has a smooth upper surface. Any number of shelves can be included. The depicted embodiment shows four different shelves 56. Each of the shelves includes a forward extent 58, a rearward extend 62, and opposing sides 64. The opposing sides 64 of the rearward extent 62 of each shelf are pivotally mounted between the pair of parallel side rails 22. As illustrated, a pair of support bars 36 supports the opposing sides of the forward extent 58 of each shelf 56.

Figure 3:
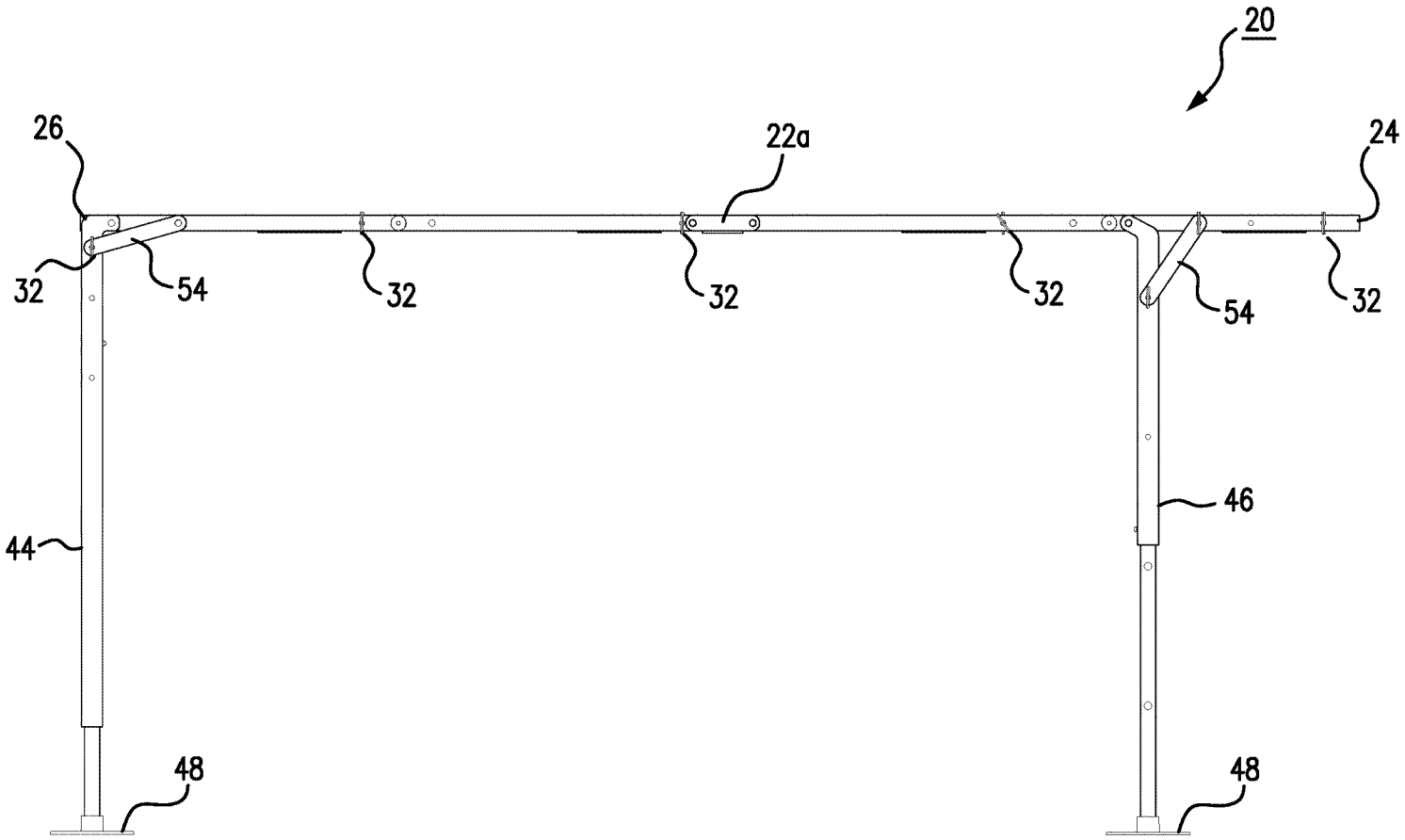
FIG. 3 is a side elevational view of the article of furniture in the flat configuration.
Figure 4:
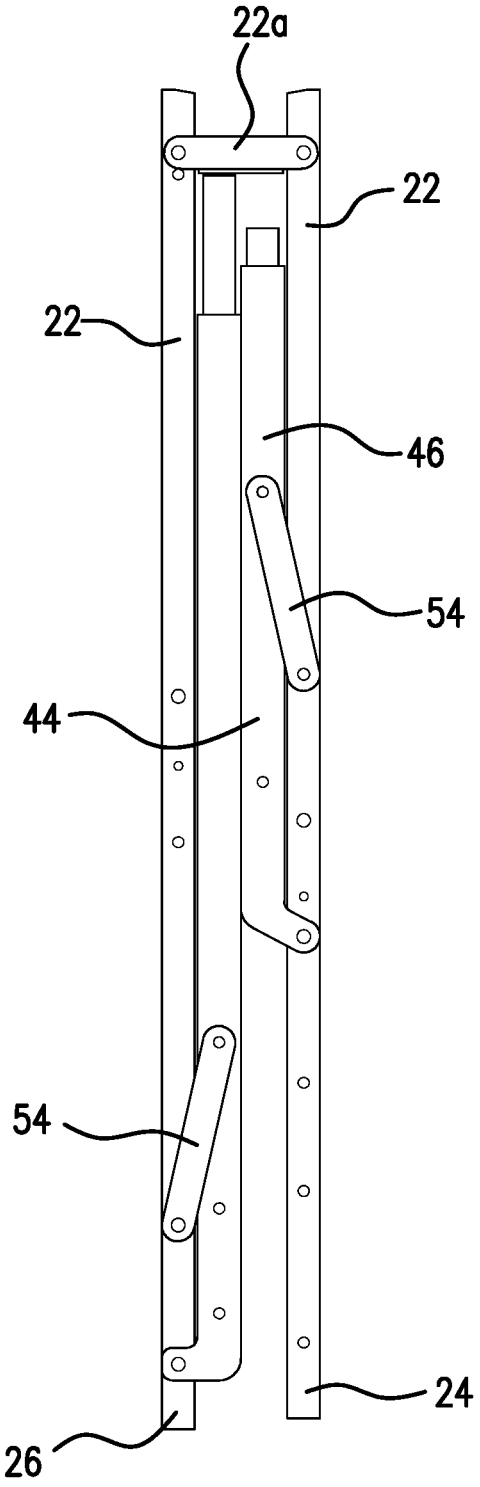
FIG. 4 is a side elevational view of the article of furniture in the collapsed configuration.

In accordance with the invention, the article includes the following configurations: tiered, flat, and collapsed. With the quick release pins 32 in position, the pivotal support bars 36 support each of the shelves 56 at an angle relative to the parallel side rails 22. This is illustrated in FIGS. 1 and 2 and corresponds to the tiered configuration. The quick release pins 32 can be removed such that the support bars 36 no longer support the individual shelves 56. This, in turn, permits each of the shelves 56 to rest upon corresponding braces 34 found upon the parallel side rails 22. This permits the shelves 56 to be aligned with the side rails. This is depicted in FIG. 3 and corresponds to the flat configuration. In the configuration of FIG. 3, the forward and rearward legs have been adjusted to be of equal length.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An article of furniture that is convertible between flat, tiered, and collapsed configurations, the article of furniture comprising:

a pair of parallel side rails, each parallel side rail having a forward extent, a rearward extent, and an intermediate extent therebetween, a series of quick release pins and braces formed along the length of each side rail, each side rail further including a linkage permitting the side rail to be pivoted at the intermediate extent;

a series of pivotal support bars, each of the support bars having a proximal end that is removably coupled to the intermediate extent of the parallel side rails by way of a corresponding quick release pin, each of the support bars having a distal end;

a pair of rearward legs pivotally connected to the rearward extent of the parallel side rails, the rearward legs being telescopically adjustable between extended and retracted positions, a pair of feet removably mounted to the bottom of the rearward legs, a cross bar positioned between the rearward legs;

a pair of forward legs pivotally connected to the forward extent of the parallel side rails, the forward legs being telescopically adjustable between extended and retracted positions, a pair of feet removably mounted to the bottom of the forward legs, a cross bar positioned between the forward legs;

a series of shelves, each of the shelves having a forward extent, a rearward extent, and opposing sides, the opposing sides of the rearward extent of each shelf being pivotally mounted between the pair of parallel side rails, a plurality of support arms spanning from the forward extent to the rearward extent, and a pair of support bars supporting the opposing sides of the forward extent of each shelf;

whereby with the quick release pins in position, the pivotal support bars support each of the shelves at an angle relative to the parallel side rails such that the article is in the tiered configuration, and whereby the quick release pins can be removed to permit each of the shelves to rest upon corresponding braces such that the shelves and parallel side rails are in alignment with one another and the article is in the flat configuration, the article further including a collapsed configuration wherein the quick release pins are removed and each side rail is folded at the intermediate extent.

2. A convertible article of furniture comprising:

a pair of side rails, braces formed along an intermediate extent of the parallel side rails, a series of pivotal support bars positioned along the pair of side rails, each side rail being foldable at an intermediate extent via a linkage;

forwardly and rearwardly located legs for use in supporting the side rails above the ground, the legs being pivotally connected to the side rails;

a series of shelves, each shelf being pivotally mounted between the pair of side rails and further comprising a plurality of support arms spanning a forward extent and rearward extent of each shelf;

whereby the support bars can be used to selectively support the shelves at an angle relative to the side rails and wherein the shelves can alternatively be supported by the braces such that the shelves are aligned with the side rails, and wherein the article can be collapsed by folding the side rails.

* * * * *